US005908664A

United States Patent [19]

Nagayama

[11] Patent Number: 5,908,664

[45] Date of Patent: Jun. 1, 1999

[54] METHOD OF WORKING METAL MEMBER

[75] Inventor: Yutaka Nagayama, Osaka, Japan

[73] Assignee: Nagayama Electronic Industry Co., Ltd., Wakayama, Japan

[21] Appl. No.: 08/908,629

[22] Filed: Aug. 7, 1997

[30] Foreign Application Priority Data

Apr. 25, 1997 [JP] Japan ..... 9-109047
Jun. 27, 1997 [JP] Japan ..... 9-171883

[51] Int. Cl.[6] ..... B05D 3/12

[52] U.S. Cl. ..... 427/358; 72/42; 427/369

[58] Field of Search ..... 427/384, 388.1, 427/358, 369; 72/42

[56] References Cited

U.S. PATENT DOCUMENTS 3,923,671 12/1975 Knepp ..... 508/495
5,314,632 5/1994 Papke et al. ..... 508/234

*Primary Examiner*—Michael Lusignan
*Attorney, Agent, or Firm*—W. F. Fasse; W. G. Fasse

[57] ABSTRACT

In a method of working a metal member, a liquid synthetic detergent mainly composed of a surface-active agent is supplied to a metal plate as a lubricant in a press working step of holding the metal plate between a male die and a female die and press-forming the same. According to this working method, press working of a stainless steel plate or the like can be smoothly performed due to excellent lubricity of the surface-active agent contained as the main component in the liquid synthetic detergent. When a lubricant prepared from a liquid synthetic detergent containing a rust preventive is applied to lubrication of a carbon steel plate or the like, excellent workability can be attained without rusting, due to the action of the rust preventive, and with no contamination by oil.

27 Claims, 6 Drawing Sheets

METHOD OF WORKING METAL MEMBER

BACKGROUND OF THE INVENTION

1. Field of the Invention

The present invention relates to a method of working a metal member, and more particularly, it relates to an improvement in a lubricating method while working a material consisting of a corrodible metal material such as a ferrous metal other than stainless steel, or a material consisting of a relatively work-hardenable metal material having high corrosion resistance such as stainless steel or a titanium alloy, and forming a prescribed member.

2. Description of the Background Art

Referring to FIGS. 1A to 5, conventional steps of working a ferrous material related to the present invention will now be described with reference to an example of steps of manufacturing a T nut including a step of intermittently progressively press working a plate of a ferrous metal material other than stainless steel, such as a carbon steel plate, for example, and a step of forming a female screw with a tapping machine.

A T nut 31 shown in FIGS. 1A and 1B is generally manufactured through a progressive press working step shown in FIGS. 2A and 2B. Referring to FIGS. 1A and 1B, the T nut 31 manufactured by this method comprises a shaft part 32 and a flange part 33 outwardly extending from a first end portion of the shaft part 32. The shaft part 32 comprises a female screw forming portion 35 which is in the form of a hollow cylinder having a uniform outer diameter and provided with a female screw 36 on its inner peripheral surface.

Two pairs of pawls 37, 38, 39 and 40 are arranged on the outer periphery of the flange part 33 to be opposite to each other along the diametrical direction of the flange part 33. Each of the pawls 37 to 40 is formed by bending upright a part of the outer peripheral edge of the flange part 33. The flange part 33 has a substantially octagonal shape as a whole. In particular, the pair of pawls 37 and 38 and the other pair of pawls 39 and 40 are connected with each other by linear sides 41 and 42 respectively.

The T nut 31 shown in FIGS. 1A and 1B is manufactured as follows. Referring to FIGS. 2A and 2B, first a longitudinal strip-shaped metal plate 10 consisting of a ferrous material is prepared. This metal plate 10 is caused to move intermittently pitch by pitch along its longitudinal direction as shown by arrows X in FIGS. 2A and 2B, to be subjected to desired working at each stopped position. Therefore, working zones i to vii in FIGS. 2A and 2B successively show working steps carried out in order in a single working space along the metal plate 10.

As shown on the right end of FIG. 2B, a lubricant is continuously supplied to the upper surface of the moving metal plate 10 from a supply port 50 of a lubricant supply unit. In the steps of manufacturing the T nut 31 from a ferrous plate, mineral oil, animal oil or vegetable oil having a rust preventive function is generally employed as the lubricant for the material itself which is easy to rust.

First, cut lines 11*a* and 11*b* are formed on the metal plate 10 by cutting substantially along a circular shape in the working zone i, for locating a portion for forming the flange part 33. At this time, uncut parts 12*a* and 12*b* are defined in two opposite portions of the circle defined by the cut lines 11*a* and 11*b* along the cross direction of the strip-shaped metal plate 10. Then, cut lines 13*a* and 13*b* are formed generally along a second circle that is concentric with and outside of the circle defined by the cut lines 11*a* and 11*b*, in the working zone ii. These cut lines 13*a* and 13*b* define uncut parts 14*a* and 14*b* in the vicinity of both edges along the longitudinal direction of the metal plate 10.

Then, a worked portion 16 enclosed within the inner cut lines 11*a* and 11*b* is drawn in the working zone iii. Drawing margins resulting from this drawing appear as clearances 15, and the worked portion 16 is held by coupling portions 17*a*, 17*b*, 17*c* and 17*d* connected with the uncut parts 12*a*, 12*b*, 14*a* and 14*b* with respect to the metal plate 10. The coupling portions 17*a*, 17*b*, 17*c* and 17*d* are adapted to advantageously absorb the drawing margins resulting from the drawing by deforming toward the central direction.

Then, the worked portion 16 is subjected to deeper drawing in the working zones iv and v, and thereafter a hole 18 is formed in the working zone vi. Thereafter, the hole 18 is spread as shown in the working zone vii.

Thereafter the metal plate 10 is passed through a step (not shown in FIGS. 2A and 2B) of forming the pawls 37 to 40 and the like, and then an intermediate product of the T nut 31 is separated from the metal plate 10 and barrel-polished. Then, the intermediate product is annealed in a vacuum furnace at a prescribed temperature, for relaxing work hardening that was caused during the progressive press working step, for facilitating tapping that will be carried out in a next step for forming the female screw 36, and for demagnetizing the intermediate product of the T nut 31 that became magnetized during the progressive press working step. The mineral oil or the like employed as the lubricant is inflammable and may ignite at the temperature necessary for the annealing. Therefore, it is necessary to carry out a step of cleaning the intermediate product with a solvent such as trichlene for removing the oil forming a coat on its surface before the annealing step.

The intermediate product of the T nut 31 annealed in the vacuum furnace is supplied to a tapping machine and subjected to a tapping step for forming the female screw 36 on the inner peripheral surface of the female screw forming portion 35 of the shaft part 32. Also in this tapping step, an oily lubricant such as mineral oil is employed similarly to the progressive press working step.

The tapping step for forming the female screw 36 on the inner peripheral surface of the female screw forming portion 35 of the intermediate product of the T nut 31 by the tapping machine will now be described with reference to FIGS. 4 and 5. A bent tap 71 which is held in a hollow rotary spindle 70 to rotate at about 1000 to 3000 rpm is employed in this tapping step. A plurality of T nuts 73 continuously supplied along a chute 72 are guided one by one to an end of the bent tap 71 through a stopper 74, and pressed against the bent tap 71 by a push rod 75, to be subjected to thread cutting. The bent tap 71 rotates along arrow Y with the rotary spindle 70, whereby each T nut 73 subjected to thread cutting moves along the bent tap 71 as shown by arrow Z, and is pressed by the subsequent T nut 73 to continuously move after passing through a cutting edge portion of the bent tap 71 held by tap covers 76 from both sides. Consequently, each T nut 73 passing through the inside of the rotary spindle 70 and reaching the other end of the bent tap 71 is discharged to the exterior from an opening 70*a* of the rotary spindle 70. Thus, the female screw 36 is completely formed, and the desired T nut 31 is obtained.

When the aforementioned T nut 31 worked from a plate of a ferrous material other than stainless steel is applied to a component member which is employed in a watery environment or an environment that readily corrodes metals, e.g.

with acid rain, the color of the T nut 31 is disadvantageously changed by rust. Thus, there is an increasing demand for a T nut, consisting of a corrosion-resistant material such as stainless steel SUS304 under Japanese Industrial Standards (JIS), which is rustproof under such an environment.

The aforementioned conventional plate of a ferrous material other than stainless steel has relatively high heat conductivity and is hardly work-hardened during plastic working thereof. Therefore, no particular problem is caused during working steps such as drawing when a lubricant containing oil and water and having a strong cooling effect is employed. Further, such a ferrous plate is generally provided with a satin-finished surface having small convex and concave portions. During working, therefore, oil adheres to and remains in the concave portions to maintain excellent sliding between a tool and a workpiece, and serves as a kind of cushion for preventing extreme noise during the working.

However, it has been proved that, when a T nut is prepared from a plate of stainless steel while using a water-insoluble lubricant such as mineral oil similarly to the aforementioned conventional steps of working a ferrous plate into a T nut, the following problems are caused and excellent workability cannot be attained. This arises because stainless steel is relatively hard and inferior in plastic deformability, it has relatively low heat conductivity, it is readily work-hardened, and its surface is smoother than that of a carbon steel plate or the like and hence inferior in oil adhesion.

When the shaft part 32 of the T nut 31 is formed by drawing in the progressive press working step for the plate as described with reference to FIGS. 2A and 2B, the amount of heat generation is maximized in the vicinity of the bottom portion (the forward 15 end portion of the shaft part 32) where the maximum working stress arises. Since the heat conductivity of stainless steel is so low as compared with carbon steel or the like, there is insufficient time for the temperature in the plate to be uniformalized by heat conduction, leading to maximum work hardening in the vicinity of the bottom portion. When an oily lubricant such as mineral oil is employed in the progressive pressworking step, oil having a large cooling effect forms a coating on the surface of the workpiece, and hence the work-hardened portion is cooled in the hardened state. Once such work hardening is caused in a single stage of drawing in the multistage drawing operation shown in FIGS. 2A and 2B, then the desired drawing cannot be performed in the next stage due to the hardened condition and resulting reduced flexibility of the plate. Thus, the progressive press working steps cannot be smoothly performed.

Further, the surface of the stainless steel plate is smoother than that of the carbon steel plate, having smaller irregularity and hence inferior adhesion with an oily lubricant. Thus, lubricity between the tool and the workpiece is deteriorated in working, leading to extreme frictional noise during the working.

The reason why the stainless steel plate is so hard to press-work as compared with the carbon steel plate or the like will now be described with reference to FIGS. 3A to 3C. In the stages of drawing corresponding to the working zones iii to v shown in FIGS. 2A and 2B respectively, the metal plate 10 held between female dies 21*a*, 21*b* and 21*c* and blank holders 22*a*, 22*b* and 22*c* is drawn with punches 23*a*, 23*b* and 23*c*. If it consists of carbon steel or the like, the metal plate 10 maintains a substantially uniform thickness between a base portion and a bottom portion in circles shown by arrows A and B. If the metal plate 10 consists of stainless steel or the like, however, the flow of the material from the base portion to the bottom portion in the circles shown by arrows A and B (the flow in the section of the metal plate 10 along arrows in FIGS. 3A to 3C) is so minimal or inferior that the base portion may remain rather thick, the thicknesses of the side surfaces become non-uniform, and the bottom portion may become undesirably thin. This phenomenon is conceivably caused since no lubrication is maintained between the dies 21*a*, 21*b* and 21*c* and the punches 23*a*, 23*b* and 23*c* and the metal plate 10. Instead friction is increased due to inferior adhesion between the lubricant and the stainless steel plate surface, and the material is work-hardened by the frictional heat.

Such a tendency of ununiformalization of the thickness caused by drawing is accumulated through the plurality of stages of drawing, and hence the achieved thickness of the shaft part 32 the T nut 31 may be remarkably different from the desired thickness in the working zone shown in FIG. 3C, and the bottom portion of this shaft part 32 may be broken in an extreme case.

If the oily lubricant such as mineral oil is employed also in the step of forming the female screw 36 and thread cutting is performed by tapping at the same working speed as that for a conventional T nut prepared from a carbon steel plate or the like, then burning will result due to heat generated between the tap and the material for the T nut, which hinders excellent thread cutting.

It is inferred that the aforementioned problems in drawing and thread cutting of the stainless steel plate are caused since the stainless steel plate has inferior heat conductivity and is readily work-hardened, and since the surface of the stainless steel plate is so smooth as compared with the carbon steel plate or the like that the conventional oily lubricant is readily repelled from the steel plate surface during the working even if it had been adhering to the surface. Namely, the oily lubricant cannot remain on the surface of the workpiece for maintaining lubricity which is necessary for the working.

The inventor has performed an experiment of working a stainless steel T nut similarly to the above, using a lubricant prepared by diluting "Castrol Iloform PS158", which is a water-soluble plastic working oil by Castrol Industrial Co., Ltd. used for drawing a stainless steel sink, to 10% with water in accordance with the recommended specification. The oil must conceivably be diluted with water, for preventing ignition of the oil by heat generated during working. As a result of the working experiment with the water-soluble plastic working oil, work hardening was remarkably caused in both drawing and tapping steps, and excellent workability was not attained. It is inferred that an excess cooling effect arose due to functions of the oil and water contained in the lubricant, and hence it was impossible to solve the problem of work hardening similarly to the aforementioned case of employing a mineral oil as a lubricant.

When a trial experiment similar to the above was carried out using an undiluted solution of the water-soluble plastic working oil, excellent workability was not attained similarly to the case of employing the 10% diluted solution. This is conceivably because an unpreferrable cooling effect arose due to the considerable amount of water that is contained in the undiluted solution of this water-soluble plastic working oil for preventing ignition of the oil contained therein. Hence the problem of hard working was not solved.

When an experiment for working a stainless steel T nut was performed similarly to the above using "High-Chip EX-446H", which is water-soluble lubricating oil by Taiyu Co., Ltd. containing components shown in Table 1, work hardening was remarkably caused and excellent workability was not attained. This is presumably because the lubricating oil contains mineral oil in a relatively large amount of 10 to 20%, and further contains large amounts of components such as a rust preventive additive and an antifoaming agent which are unnecessary for serving as a lubricant for stainless steel. This was the case even though the lubricating oil is mainly composed of a surface-active agent. Hence it was impossible to solve the problem of work hardening due to a cooling effect caused by these unnecessary components, similarly to the aforementioned case of employing mineral oil.

TABLE 1

Composition of High-Chip EX-446H (Water-Soluble Cutting Oil)

| Component | Content |
|---|---|
| surface-active agent | 40–60% |
| purified mineral oil | 10–20% |
| chlorine extreme pressure additive | 10–20% |
| sulfur extreme pressure additive | 20–30% |
| rust preventive additive | 1–10% |
| antifoaming agent | not more than 1% |

The problem of inferior working properties caused by work hardening resulting from inferior heat conductivity arises not only in stainless steel, but is common to materials such as a titanium alloy having high corrosion resistance. The development of a lubricating method which can solve this problem has been long awaited.

In case of machining a plate of a ferrous material other than stainless steel, which can attain relatively excellent workability with an oily lubricant such as mineral oil in general, the lubricating oil typically spills on the floor. Over time the lubricating oil deeply infiltrates into the ground and thereby contaminates ground water and other ground resources, to cause environmental pollution. Also in relation to working a corrodible, metal material, therefore, the development of an oil-free lubricant having excellent lubricity is much awaited.

SUMMARY OF THE INVENTION

An object of the present invention is to provide a working method which can attain excellent workability in working of a corrosion-resistant metal material such as stainless steel.

Another object of the present invention is to provide an oil-free lubricant which causes no rusting on a workpiece and can attain excellent lubricity in case of working a corrodible metal material such as a ferrous material other than stainless steel.

Still another object of the present invention is to provide a working method which can lubricate not only a metal material that is to be worked but also working equipment consisting Of a corrodible material.

In order to attain the aforementioned objects, a method of working a metal member according to a first aspect of the present invention is characterized in that a liquid synthetic detergent mainly composed of a surface-active agent is supplied as a lubricant to a metal plate consisting of a readily work-hardened material in a press working step of holding the metal plate between male and female dies and press-forming the same.

According to this working method, unnecessary components other than the surface-active agent, which is the main component, and another component contributing to lubrication are evaporated by heat generated by friction between the tool and the workpiece during the press working, so that a substance containing the surface-active agent and having high viscosity contributing to lubrication remains and forms a coating on the surface of the workpiece. The substance having high viscosity, which is mainly composed of the surface-active agent, strongly adheres to a relatively smooth surface such as that of a stainless steel plate and readily forms a coating thereon. Hence, this substance is not repelled by the dies in the press working step but ensures excellent lubricity between the male and female dies and the workpiece.

The formed coating of the surface-active agent does not cause a remarkable cooling effect dissimilarly to an oily lubricant, whereby heat generated during working is kept in the workpiece and uniformalized by heat conduction, for properly maintaining the workpiece at a high temperature. Consequently, a heat treatment effect similar to a kind of annealing is attained. This effect relaxes any work hardening once it is caused during the working, whereby intermittently repeated press working can be smoothly performed. Further, frictional noise caused during the working can be remarkably reduced due to improvement in lubricity.

According to a second aspect of the present invention, a method of working a metal member is characterized in that a liquid synthetic detergent is employed as a lubricant for working a metal material consisting of a corrosion-resistant metal material and forming a prescribed member.

According to this working method, the corrosion resistant metal material can be smoothly worked due to excellent lubricity of a surface-active agent contained as the main component in the liquid synthetic detergent. Excellent working of the corrosion-resistant metal material can be attained by employing the liquid synthetic detergent as a lubricant in place of an oily lubricant such as mineral oil, conceivably for the following reason.

In general, a liquid synthetic detergent contains at least about 20 wt. % of surface-active agent. In working, unnecessary components are evaporated by heat resulting from friction between the tool and the workpiece while leaving behind the surface-active agent, which is the main component, and another relatively unevaporable component having high viscosity and contributing to lubrication, so that the surface-active agent of high purity remains on the surface of the workpiece and forms a coating thereon. Such a coating of the surface-active agent of high purity maintains excellent sliding between the tool and the workpiece during the working. The cooling effect, of the surface-active agent of high purity forming the coating is weak as compared with an oily lubricant such as mineral oil.

Therefore, even if work hardening is caused in the vicinity of the bottom portion of the shaft part 32 of the T nut 31 in a single stage of drawing in the multistage drawing steps shown in FIGS. 2A and 2B, for example, the synthetic detergent forming the coating on the surface of the T nut 31 cools, i.e. removes heat from, the surface portion at a slower rate as compared with the oily lubricant. Thus, the amount of heat dissipated from the surface of the T nut 31 is relatively reduced, and the temperature of the overall T nut 31 is uniformalized at a relatively high level due to heat conduction in the T nut 31. Consequently, a portion close to the bottom portion of the shaft part 32 of the T nut 31, once work-hardened by drawing, recovers its flexibility to be excellently drawn in the next stage, thereby reducing deterioration of workability following the work hardening. It is conceivable that such a phenomenon takes place in each stage of drawing to smooth the multistage drawing.

Such an effect of the liquid synthetic detergent is attained not only in the drawing step but in the tapping step for forming the female screw 36 of the T nut 31 and in other machining such as cutting.

As hereinabove described, the liquid synthetic detergent is employed as a lubricant in the inventive method of working a metal member, whereby no oil spills from the lubricant to infiltrate into the ground and contaminate ground water, dissimilarly to the prior art. Thus, the method according to the present invention attains a remarkable effect in view of prevention of environmental contamination.

In a preferred embodiment of the present invention, the method of working a metal member is particularly preferably applied to drawing of a plate consisting of a corrosion-resistant metal material such as stainless steel or a titanium alloy, and is particularly effectively employed for press working including a plurality of stages of drawing for forming a shaft part of a T nut from a plate of stainless steel, for example.

Thus, working equipment similar to that used for working a conventional carbon steel plate can be employed by simply changing the lubricant for a plurality of stages of drawing for forming a shaft part of a T nut from a plate of stainless steel, without changing working conditions such as a working speed and working steps, whereby the manufacturing cost can be remarkably reduced.

In working of a stainless steel T nut, the aforementioned method of working a metal member according to the second aspect of the present invention is applicable not only to drawing of its shaft part but also to thread cutting for forming a female screw on the inner periphery of the shaft part. In this regard, the inventive working method can be effectively applied to a series of working stages including a plurality of stages of drawing for forming the shaft part of the T nut from a plate of stainless steel and thread cutting for forming the female screw on the inner periphery of the shaft part of the T nut.

When the aforementioned lubricant is employed for the step of forming the female screw of the stainless steel T nut, tapping can be performed without an annealing step before the female screw forming step. This is conceivably because the temperature of an intermediate product of the T nut is properly increased during the tapping due to the aforementioned lubricant providing only the lubricating effect with suppression of the cooling effect, to attain a heat treatment effect similar to annealing, and thus facilitate the tapping.

Further, the basic technique of the present invention employing the liquid synthetic detergent as the lubricant for working the corrosion-resistant metal member is also effectively applicable to rolling of a plate or a wire consisting of a corrosion-resistant metal using a roller, to formation of a nut from a wire of a corrosion-resistant metal material, or to thread cutting for forming a female screw on the nut, and excellent workability can be attained also in such working.

By applying such a manufacturing method to a rolling process of a stainless plate, the process speed of rolling the stainless plate, which normally in a conventional process would have to be set much lower than that for rolling a plate of nonstainless carbon steel, can be set according to the invention at approximately the same speed as the speed of rolling a plate of nonstainless carbon steel. Further, an annealing process which is essentially required in the conventional process of rolling a stainless plate can be cut down. Accordingly, the cost for manufacturing a stainless plate can be reduced drastically by applying the manufacturing method of the present invention.

In a method of working a metal member according to a third aspect of the present invention, a liquid which is mainly composed of a surface-active agent and further contains at least polyoxyethylene alkyl ether, alkyl sulfuric ester and fatty acid is employed as a lubricant for working a plate of stainless steel and forming a prescribed member.

According to this working method, excellent lubricity can be attained in working of a member consisting of stainless steel by a function similar to those in the methods of working metal members according to the first and second aspects of the present invention.

According to a fourth aspect of the present invention, a method of working a metal member is characterized in that a liquid prepared from a liquid synthetic detergent which is mainly composed of a surface-active agent and contains a rust preventive is supplied as a lubricant to a metal plate in a press working step of holding the metal plate between male and female dies and press-forming the same.

When this working method is applied to press working of a corrosion-resistant metal material such as stainless steel which is relatively readily work-hardened, an effect similar to that of the working method according to the first aspect of the present invention can be attained by a function of the surfaceactive agent contained in the liquid synthetic detergent.

The liquid containing the rust preventive that is employed as the lubricant causes no rust even if it adheres to working equipment such as a corrodible working machine, and hence it is unnecessary to provide shielding means for preventing the lubricant from scattering.

Also when the liquid is applied as a lubricant for working a corrodible metal material such as a ferrous material other than stainless steel, excellent lubricity is attained due to the function of the surface-active agent contained in the liquid synthetic detergent, and corrosion is prevented by the function of the rust preventive. Thus, excellent workability is attained with the oil-free lubricant also in working of the ferrous metal material other than stainless steel which has generally been lubricated with mineral oil or the like in the past, whereby a remarkable effect can be attained for solving various problems caused by the oil contained in the conventional lubricant.

In a method of working a metal member according to a fifth aspect of the present invention, a liquid containing a liquid synthetic detergent and a rust preventive is employed as a lubricant for working a metal material and forming a prescribed member.

When this working method is applied to press working of a corrosion-resistant metal material such as stainless steel which is relatively readily work-hardened, an effect similar to that of the working method according to the first aspect of the present invention can be attained by a function of a surfaceactive agent contained in the liquid synthetic detergent.

The liquid containing the rust preventive that is employed as the lubricant causes no rust even if it adheres to working equipment such as a corrodible working machine, whereby no shielding means may be prepared for preventing the lubricant from scattering.

Also when the liquid is applied as a lubricant for working a corrodible metal material such as a ferrous material other than stainless steel and forming a prescribed member, excellent lubricity is attained due to the function of the surface-active agent contained in the liquid synthetic detergent, and corrosion is prevented by the function of the rust preventive. Thus, excellent workability is attained with the oil-free lubricant also in working of the ferrous metal material other than stainless steel which has generally been lubricated with mineral oil or the like in the past, whereby a remarkable effect can be attained for solving various problems caused by the oil contained in the conventional lubricant.

The function of the liquid synthetic detergent is attained not only in a drawing step but in a tapping step for forming a female screw of a T nut and in other machining operations such as cutting.

As hereinabove described, the liquid synthetic detergent is employed as the lubricant in the method of working a metal member according to each of the aforementioned aspects of the present invention, whereby no oil spills from the lubricant to infiltrate into the ground and contaminate ground water, dissimilarly to the prior art. Thus, the method according to the present invention attains a remarkable effect in view of prevention of environmental contamination.

In a method of working a metal member according to a sixth aspect of the present invention, a liquid which is mainly composed of a surface-active agent and further contains at least polyoxyethylene alkyl ether, alkyl sulfuric ester, fatty acid and a rust preventive is employed as a lubricant for working a plate of a metal and forming a prescribed member.

According to this working method, excellent lubricity can be attained in working of a member consisting of a corrosion-resistant metal material such as stainless steel or a corrodible ferrous metal material other than stainless steel by a function similar to those of the working methods according to the fourth and fifth aspects of the present invention, and various problems caused by oil contained in the conventional lubricant are solved.

Each of the methods of working metal members according to the fifth and sixth aspects of the present invention is particularly preferably applied to drawing of a plate consisting of a metal material, and particularly effectively employed for press working including a plurality of stages of drawing for forming a shaft part of a T nut from a plate Of a metal, for example.

In working of a T nut, each of the working methods according to the fifth and sixth aspects of the present invention is applicable not only to drawing of a shaft part thereof but also to thread cutting for forming a female screw on the inner periphery of the shaft part, whereby the working method according to the present invention can be effectively applied to a series of working stages including a plurality of stages of drawing for forming a shaft part of a T nut from a metal plate and thread cutting for forming a female screw on the inner periphery of the shaft part of the T nut.

When the aforementioned lubricant is employed for a step of forming a female screw of a T nut, tapping can be performed with no annealing step before the female screw forming step. This is conceivably because the temperature of an intermediate product of the T nut is properly increased during the tapping due to the aforementioned lubricant providing only the lubricating effect with suppression of a cooling effect, to attain a heat treatment effect similar to annealing, and thus facilitate the tapping.

Further, the basic technique of the present invention employing the liquid containing the liquid synthetic detergent and the rust preventive as the lubricant for working a metal member is also effectively applicable to rolling of a plate or a wire consisting of a metal using a roller, to formation of a nut from a wire of a metal material, or to thread cutting for forming a female screw on the nut, and excellent workability can be attained also in such working.

The present invention also includes a working method employing a liquid containing a liquid synthetic detergent and a rust preventive not only as a lubricant for working a metal material to be worked itself but as a lubricant for working equipment such as a working machine for working the metal material that is to be worked.

Thus, the liquid containing the liquid synthetic detergent and the rust preventive is employed also as a lubricant for the working equipment, whereby a working machine or the like can also be excellently lubricated by an oil-free lubricant. Consequently, various problems resulting from employment of a lubricant containing oil are further thoroughly solved and a remarkable effect can be attained for lubricating the workpiece itself and the working machine together.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
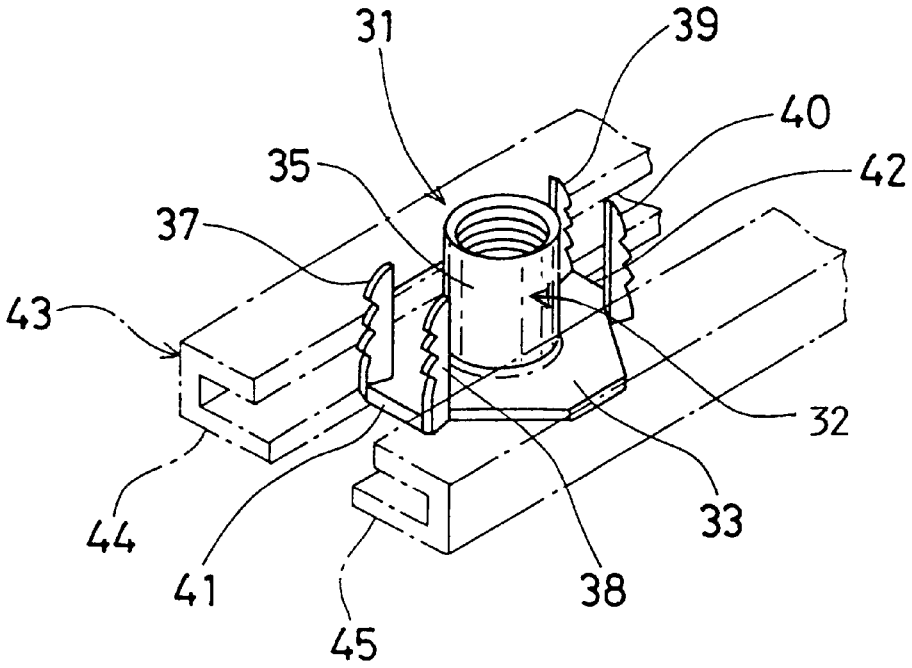
FIG. 1A PRIOR ART
FIG. 1A is a perspective view for illustrating a finished product of a T nut manufactured through a working step referred to as the prior art and each embodiment of the present invention.
Figure 1B:
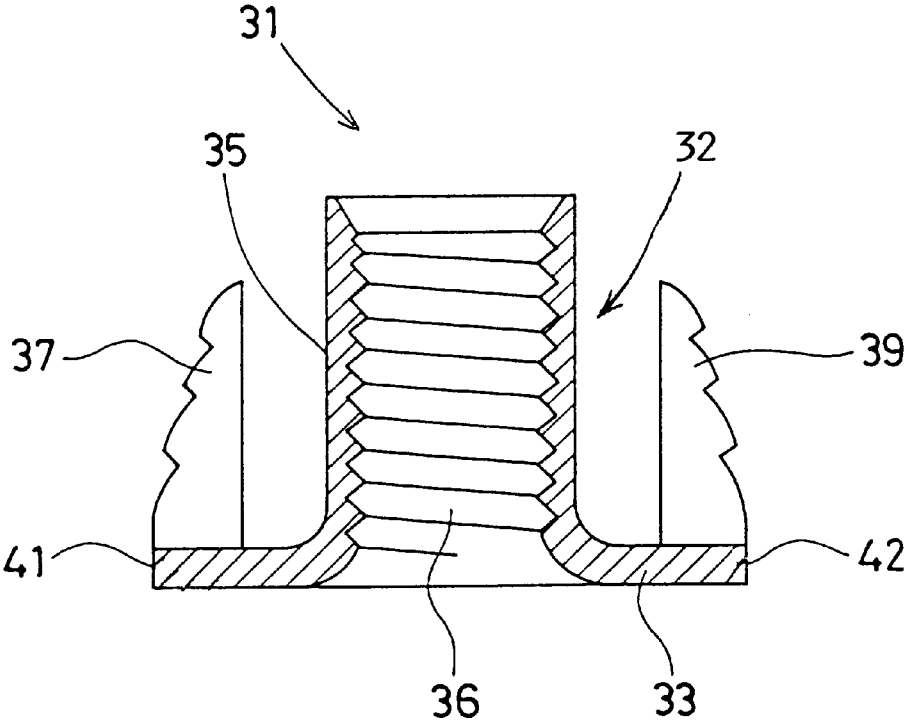
FIG. 1B PRIOR ART
FIG. 1B is a longitudinal sectional view of the T nut.

A first embodiment of the present invention is now described particularly with reference to a stainless steel T nut prepared from a plate consisting of stainless steel. Also in this case of manufacturing a stainless steel T nut according to the invention, it is basically possible to employ substantially the same progressive press working step as described with reference to FIGS. 1A, 1B, 2A and 2B for manufacturing the T nut 31 from a carbon steel plate including the multistage drawing step for forming the shaft part 32. Thus, common reference numerals are employed in the following description of the embodiment of the present invention on the basis of FIGS. 1A, 1B, 2A and 2B, and a redundant description is omitted.

Figure 2A:
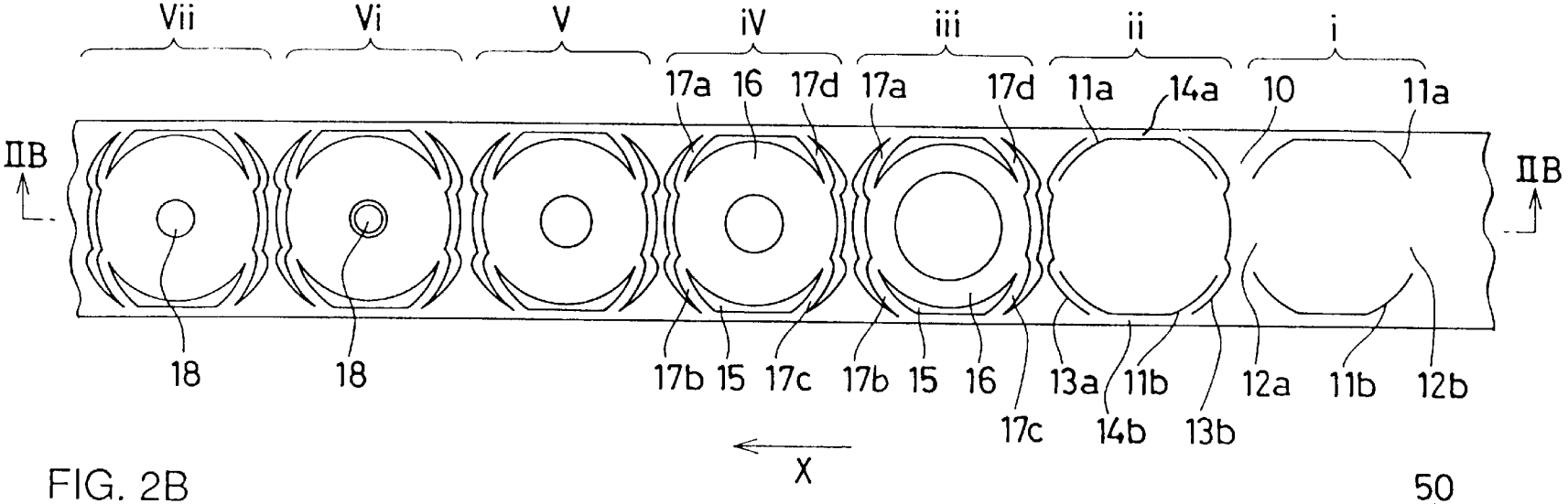
FIG. 2A PRIOR ART
FIG. 2A is a plan view showing states of working successively performed on a metal plate for obtaining the T nut shown in FIGS. 1A and 1B.
Figure 2B:
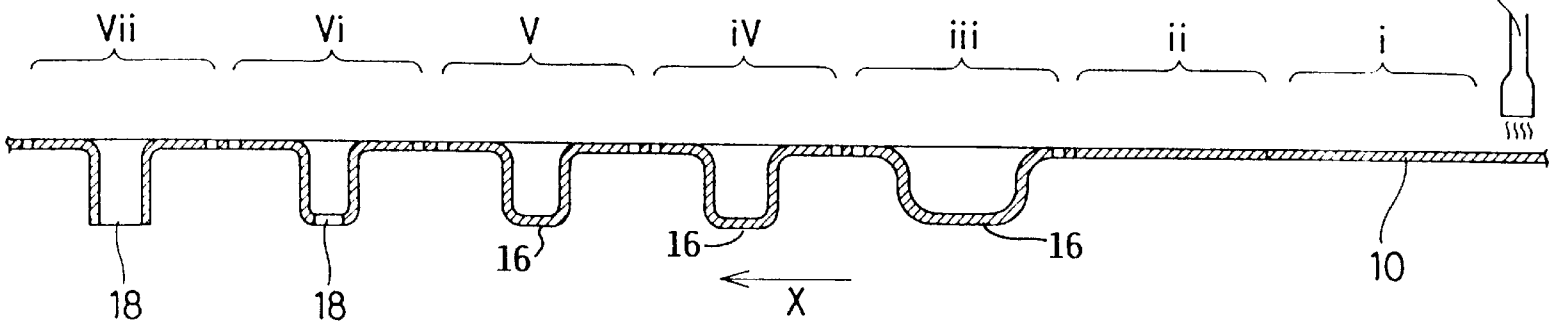
FIG. 2B is a sectional view taken along the line IIB—IIB in FIG. 2A.
Figure 3A:
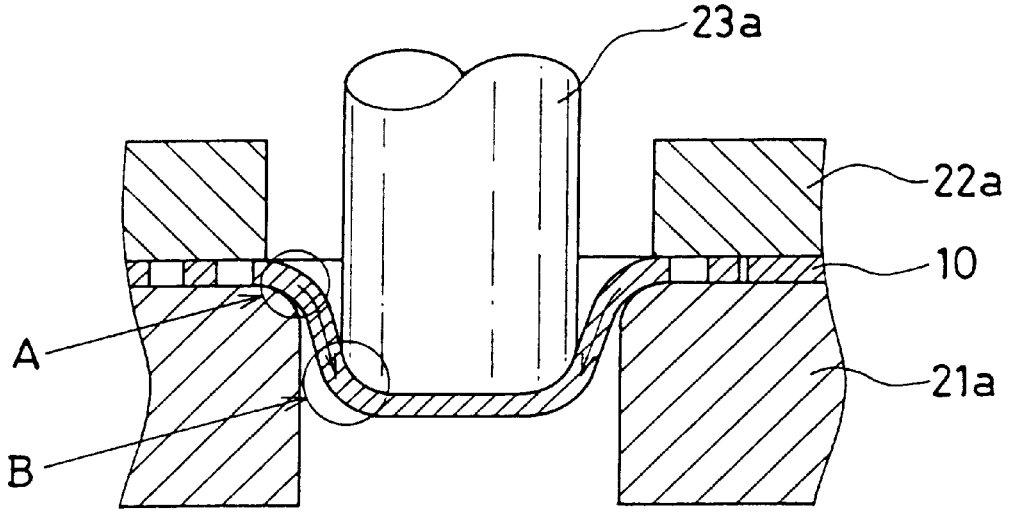
FIG. 3A PRIOR ART
FIGS. 3A, 3B and 3C are sectional views showing sections of working zones iii, iv and v in FIG. 2B respectively in an enlarged manner, for illustrating drawing workability in detail.
Figure 3B:
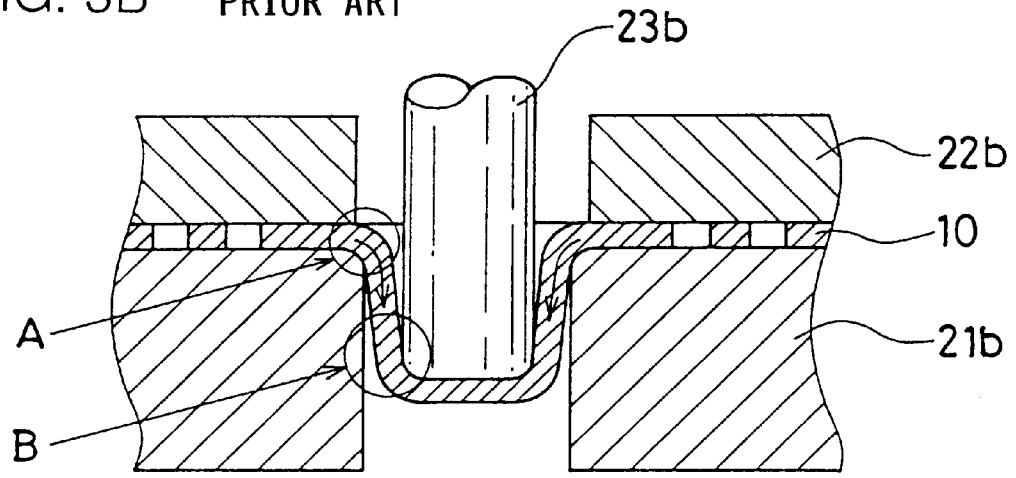
FIG. 3B PRIOR ART
Figure 3C:
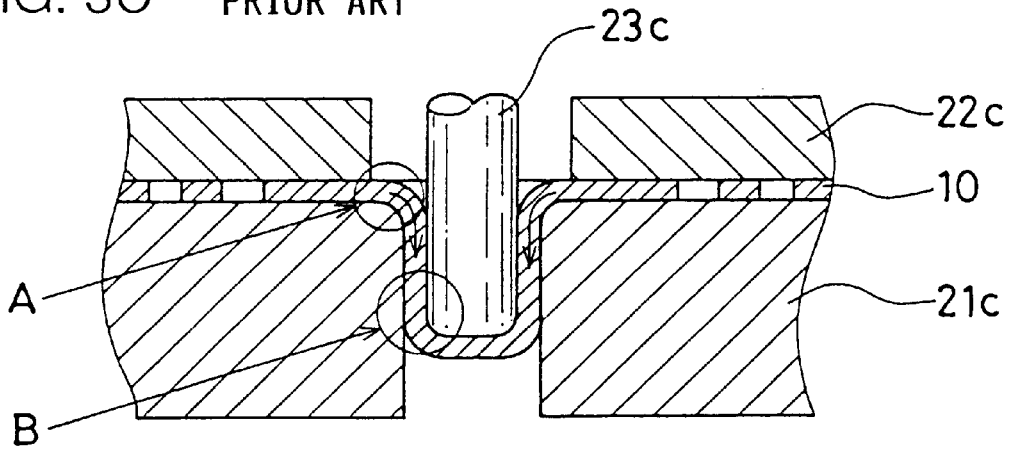
FIG. 3C PRIOR ART
Figure 4:
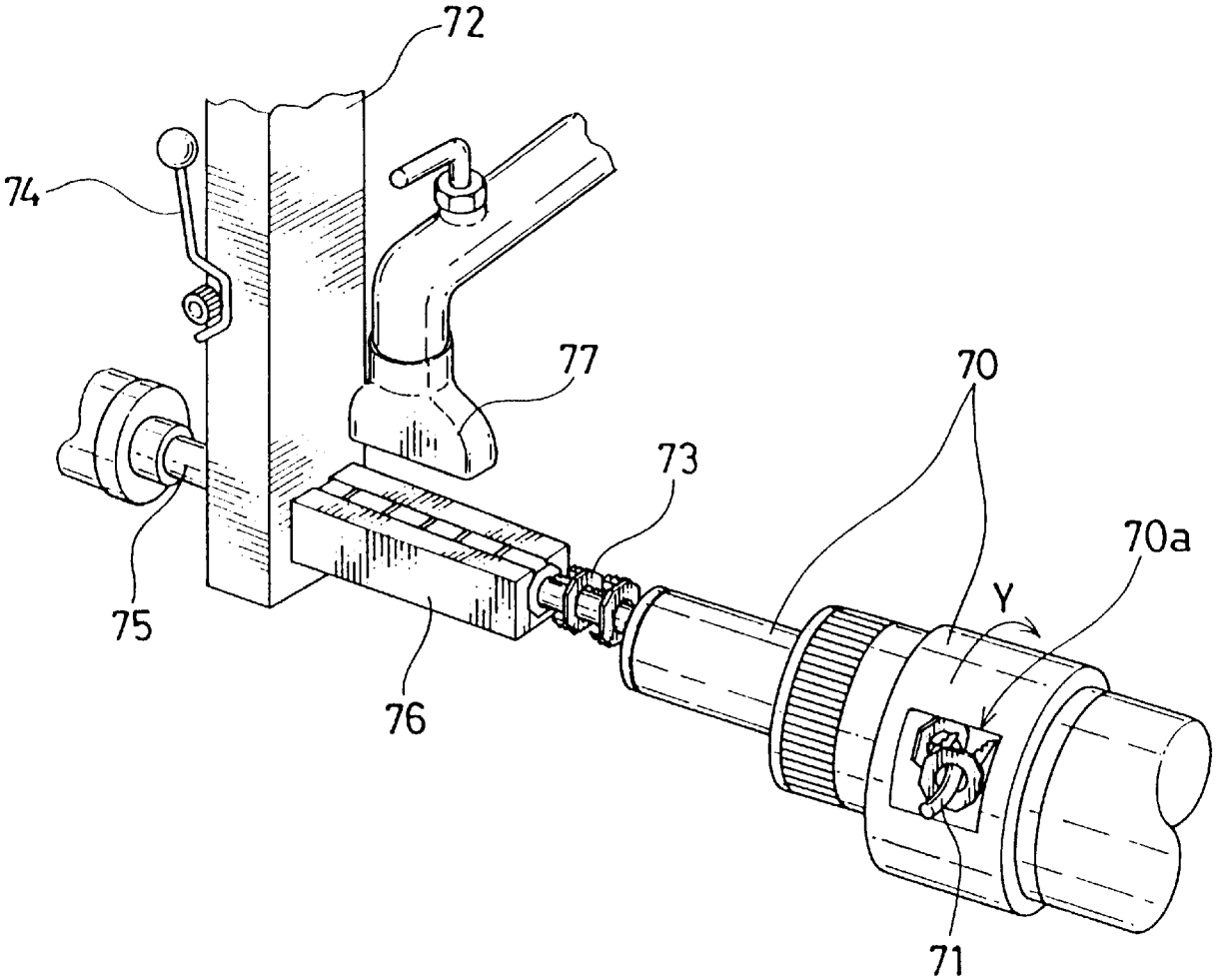
FIG. 4 PRIOR ART
FIG. 4 is a perspective view showing a principal part of a tapping machine for forming a female screw on the inner periphery of a shaft part of an intermediate product for obtaining the T nut shown in FIGS. 1A and 1B.
Figure 5:
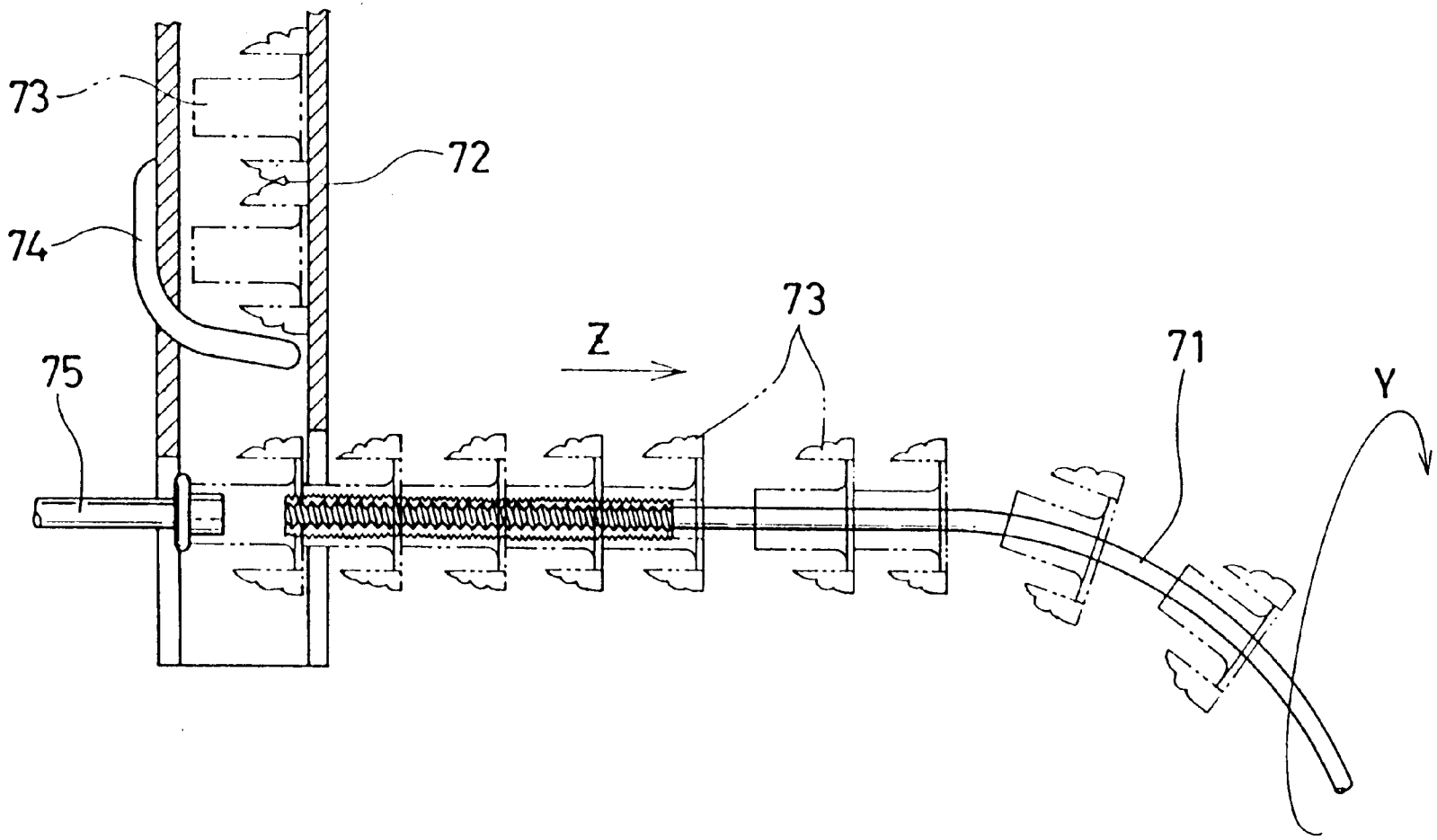
FIG. 5 PRIOR ART
FIG. 5 is adapted to illustrate a state of successively thread-cutting the T nut with a bent tap in the tapping machine shown in FIG. 4.

Referring to FIGS. 2A and 2B, a longitudinal strip-shaped metal plate 10 consisting of stainless steel such as SUS304 according to the Japanese Industrial Standard (JIS) is first prepared in this embodiment. This metal plate 10 is intermittently moved pitch by pitch along its longitudinal direction as shown by arrow X, to be subjected to a desired working step at each stopped position. A liquid synthetic detergent is continuously supplied to the upper surface of the moving metal plate 10 from a supply port 50 of a lubricant supply unit, as shown on the right end of FIG. 2B.

A step or steps carried out in working zones i to vii in FIGS. 2A and 2B and a subsequent step of forming pawls 37 to 40 and the like are performed similarly to those of the aforementioned prior art. However, shielding means is preferably provided for preventing the synthetic detergent from adhering to a sliding part of the working machine, so that a lubricating oil for lubricating the bearings etc. of this sliding part is not removed by the synthetic detergent.

According to this embodiment, the liquid synthetic detergent is employed in place of an oily lubricant such as mineral oil employed in the aforementioned prior art or a water-soluble lubricant employed in a conventional step of drawing a stainless steel plate or the like, whereby workability can be remarkably improved without changing the working conditions such as a pressing load and a working speed, for example. Namely, the only change may be the type of the lubricant with respect to the working method in the conventional progressive press working step.

While the color of the surface of the workpiece slightly changes due to stress applied during working or due to generation of heat as a result of friction after a plurality of stages of drawing, this color change can be removed by washing, to a degree not damaging the fine appearance of the product. Alternatively, it is possible to remarkably reduce such color change apparent after the working by increasing the amount of the synthetic detergent serving as a lubricant.

An intermediate product of a T nut prepared by forming the pawls 37 to 40 on the outer periphery of a flange part 33, is separated from the metal plate 10, then barrel-polished, and then annealed in a vacuum furnace in preparation for carrying out tapping in the next step, similarly to the aforementioned case of the prior art. The liquid synthetic detergent serving as a lubricant employed in this embodiment contains no inflammable component, and thus does not need to be removed by washing in particular, but may be simply dried to some extent before annealing. Further, the synthetic detergent is water-soluble and can be readily removed by washing, if removal thereof is preferable. Thus, the method according to this embodiment requires no washing step using trichlene or the like, which has been necessary in the prior art, and the steps thereof can be simplified.

The intermediate product of the T nut annealed in the vacuum furnace is supplied to a tapping machine, so that the inner peripheral surface of a female screw forming portion 35 of the shaft part 32 is tapped for forming a female screw 36. According to this embodiment, a liquid synthetic detergent is employed as a lubricant also in this tapping step, similarly to the progressive press working step. Due to the employment of the liquid synthetic detergent in the step of forming the female screw 36, the intermediate product of the T nut can be excellently thread-cut under the same working conditions as the conventional tapping step.

While the intermediate product of the T nut is tapped after annealing in the aforementioned embodiment, it has been verified that the tapping can be performed in an excellent state without an intermediate annealing step by employing the liquid synthetic detergent as a lubricant in the tapping step for forming the female screw 36. It is believed that the annealing step can be omitted before the tapping since working heat generated during the tapping is kept in the workpiece and uniformalized to attain a heat treatment effect substantially similar to annealing. Thus, work hardening, once caused, is immediately relaxed.

While the above embodiment has been described with reference to formation of the so-called hopper feed T nut provided with the pawls 37 to 40 on the outer periphery of the substantially octagonal flange part 33, the steps of drawing the shaft part 32 and tapping the female screw 36 are common regardless of the shape of the flange part 33. Needless to say, therefore, the drawing and tapping steps in the aforementioned embodiment are also applicable to steps of forming a T nut having no pawls on its flange part or a T nut having a flange part of another shape such as a round flange.

Tables 2 and 3 show components of various synthetic detergents that were employed in an experiment of working stainless steel T nuts for verifying the excellent workability. Namely, each liquid synthetic detergent was employed as a lubricant in the progressive press working step for the stainless steel T nut described with reference to the above embodiment, and Tables 2 and 3 respectively also show the obtained workability thereof. Table 4 shows results of a similar working experiment performed on comparative samples using four types of emulsive silicone oil materials by Shin-Etsu Chemical Co., Ltd. In relation to the present invention, the term "liquid synthetic detergent" includes liquid detergents such as the commercially available products shown in Tables 2 and 3, for example, which are mainly composed of surface-active agents and contain other components necessary for serving as detergents.

TABLE 2

| Inventive Sample | Type of Lubricant (): Name of Manufacturer | Composition | Workability |
|---|---|---|---|
| A | Mama Lemon (Lion Corporation) | surface-active agent (27%)<br>straight-chain alkylbenzene<br>alkyl ether sodium sulfate | ○ |
| B | Charmy Green (Lion Corporation) | surface-active agent agent (21%)<br>alkyl ether sodium sulfate<br>fatty acid alkanolamide | Δ |
| C | Charmy Compact (Lion Corporation) | surface-active agent (37%)<br>alkyl ether sodium sulfate<br>fatty acid alkanolamide<br>alpha olefin sodium sulfonate<br>polyoxyethylene alkyl ether | ○ |
| D | Family Fresh (Kao Corporation) | surface-active agent (22%)<br>alkyl ether sodium sulfate | Δ |
| E | Family Fresh Compact (Kao Copor-ation) | surface-active agent (42%)<br>alkyl ether sodium sulfate<br>alkylamine oxide<br>fatty acid alkanolamide<br>alkylbetaine | ◎ |

Note) In relation to workability, ○ indicates that continuous drawing was excellently performed, and ◎ indicates that the drawing was particularly excellently performed. Δ indicates drawing was possible but continuity was insufficient.

TABLE 3

| Inventive Sample | Type of Lubricant (): Name of Manufacturer | Composition | Workability |
|---|---|---|---|
| F | More Compact (Kao Corporation) | surface active agent (42%) alkyl Glucoside alkyl ether sodium sulfate alkylamine oxide fatty acid alkanolamide | ◎ |
| G | Sofran C (Lion Corporation) | cationic surface-active agent | Δ |
| H | New Monogen Uni (P & G Far East Inc.) | surface-active agent (18%) polyoxyethylene alkyl ether alkyl ether sulfuric ester ethanolamine | Δ |
| I | Liquid Bonus (P & G Far East Inc.) | surface-active agent (51%) polyoxyethylene alkyl ether alkyl ether sulfuric ester ethanolamine alkyl sulfuric ester ethanolamine fatty acid methylglucamide fatty acid ethanolamine enzyme fluorescer | ◎ |

Note) In relation to workability, ○ indicates that continuous drawing was excellently performed, and ◎ indicates that the drawing was particularly excellently performed. Δ indicates drawing was possible but continuity was insufficient.

TABLE 4

| Comparative Sample | Type of Lubricant (): Name of Manufacturer | Composition | Workability |
|---|---|---|---|
| J | silicone KF-352 (Shin-Etsu Chemico Co., Ltd.) | silicone oil (emulsive) viscosity: 1600 | X |
| K | silicone KF-353 (Shin-Etsu Chemico Co., Ltd.) | silicone oil (emulsive) viscosity: 400 | X |
| L | silicone KF-6017 (Shin-Etsu Chemico Co., Ltd.) | silicone oil (emulsive) viscosity: 600 | X |
| M | silicone KF-615A (Shin-Etsu Chemico Co., Ltd.) | silicone oil (emulsive) viscosity: 1200 | X |

Note) In relation to workability, X indicates that drawing itself was inferiorly performed.

From the experimental results shown in Tables 2, 3 and 4, it is understood that excellent workability including continuity of drawing was attained as a whole in relation to the inventive samples A to I shown in Tables 2 and 3 employing the synthetic detergents as lubricants, as compared with the comparative samples J to M shown in Table 4 employing the silicone oil materials. It is also understood that the workability is improved as the content of the surface-active agent is increased in relation to the inventive samples A to I employing the synthetic detergents, and it can be said that contribution of the surface-active agent to improvement of workability in relation to drawing and tapping of the stainless steel material has been verified. Comparing the experimental results in relation to the synthetic detergents employed in the inventive samples A to I with each other, it can be said that a particularly remarkable effect is attained when a synthetic detergent containing at least polyoxyethylene alkyl ether, alkyl sulfuric ester and fatty acid in addition to a surface active agent which is the main component is employed.

When the synthetic detergents were employed as lubricants in the inventive samples A to I, frictional noise caused during working was remarkably reduced as compared with the case of employing the silicone oil materials for the comparative samples J to M. Thus, it is understood that lubricity is improved by the working method according to the present invention.

In order to verify excellent workability attained by employing a liquid synthetic detergent as a lubricant in the tapping step for forming the female screw of the stainless steel T nut described in the above embodiment, a tapping experiment was is performed on unannealed and annealed intermediate products of stainless steel T nuts by employing the synthetic detergents for the inventive samples A to I shown in Tables 2 and 3 as lubricants and employing the silicone oil materials for the comparative samples J to M shown in Table 4 respectively. In this experiment, a tapping machine was employed with bent taps of 8×1.25 millimeters and 5/16 to 18 inches. Consequently, tendencies substantially similar to those of the results shown in Tables 2 to 4 were obtained in relation to workability as to all of the unannealed and annealed intermediate products.

Thus, it can be said that the inventive method employing a liquid synthetic detergent mainly composed of a surface-active agent as a lubricant in working of stainless steel has been verified as effectively applicable not only to drawing but also to cutting such as thread cutting. Further, a tapping property substantially similar to that of an annealed intermediate product was attained also in each unannealed intermediate product of the stainless steel T nut. Thus, it is conceivable that heat generated during working is not absorbed by the lubricant but kept in the workpiece due to the lubrication provided by the liquid synthetic detergent, such that a phenomenon of relaxing work hardening takes place similarly as is achieved by annealing. Thus, it can be said that a remarkable production step of tapping an intermediate product of a stainless steel T nut separated from a metal plate with no annealing step has been verified as implementable.

The inventive method of working a metal member is widely and effectively applicable to a step of forming not only the stainless steel T nut described with reference to the above embodiment but also a stainless steel flexible tube employed for a sprinkler for fire prevention, and to a rolling step of cold-rolling a stainless steel plate (or a stainless steel wire) 63 with rollers 61 and 62 shown in FIG. 6, a step of manufacturing an intermediate product of a nut such as a butterfly nut shown in FIGS. 7A and 7B from a wire of stainless steel, a step of forming a female screw on the intermediate product of the nut by tapping, and the like.

A second embodiment of the present invention will now be described. This embodiment is identical to the aforementioned first embodiment in relation to the material for a plate, working conditions and the like, except that the lubricant is changed. According to this embodiment, a liquid prepared by introducing a rust preventive into each liquid synthetic detergent employed as the lubricant in the first embodiment, is employed as a lubricant in a progressive press working step including a multistage drawing step for forming a shaft part of a stainless steel T nut and a step of forming a female screw on the shaft part in the case of manufacturing the stainless steel T nut from a plate consisting of stainless steel, and the material for the T nut is worked under exactly the same conditions as the first embodiment. Therefore, steps of this embodiment are identical to those of the first embodiment except that a liquid prepared by introducing a rust preventive into a liquid synthetic detergent is continuously supplied from the supply port 50 of the lubricant supply unit shown on the right end in FIG. 2B to the upper surface of the moving metal plate 10, and hence a redundant description is omitted.

Also in this embodiment, shielding means is preferably provided for preventing the synthetic detergent from adhering to the sliding part of the working machine, so that the lubricating oil for lubricating the bearings etc. of this sliding part is not removed by the synthetic detergent. However, the lubricant employed in this embodiment containing the rust preventive will not cause rusting of the working equipment even if the lubricant adheres to the working equipment such as dies or the like consisting of a corrodible ferrous metal.

Thus, a liquid prepared by introducing a rust preventive into a liquid synthetic detergent is employed as a lubricant in this embodiment in place of the oily lubricant such as mineral oil employed in the aforementioned prior art or the water-soluble lubricant employed for the conventional step of drawing a stainless steel plate, whereby the workability can be remarkably improved in relation to the working method in the conventional progressive press working step without changing the working conditions such as the pressing load and the working speed, while only changing the type of the lubricant. Further, the lubricant is prevented from rusting the working equipment such as dies, due to the function of the rust preventive contained therein.

The content of the rust preventive in the lubricant, sufficient for preventing rusting of the equipment, does not diminish the desirable functions and effects of the first embodiment, namely remarkably reducing the color change of the workpiece resulting from stress caused during the working or from generation of heat due to friction, and allowing removal of the lubricant adhering to the workpiece by simple washing without requiring cleaning with trichlene or the like.

An intermediate product of the T nut annealed in a vacuum furnace is supplied to a tapping machine, so that the inner peripheral surface of a female screw forming portion 35 of its shaft part 32 is tapped for forming a female screw 36. According to this embodiment, the liquid prepared by introducing a rust preventive into a liquid synthetic detergent is employed also in the tapping step as a lubricant, similarly to the progressive press working step. Due to the employment of the liquid prepared by introducing a rust preventive into a liquid synthetic detergent in the step of forming the female screw 36, the intermediate product can be excellently thread-cut under the same working conditions as the conventional tapping step, and rusting of the working equipment such as the tapping machine can be prevented.

Also by the employment of the lubricant according to this embodiment, tapping can be excellently performed without an annealing step, similarly to the aforementioned first embodiment.

Also as to this embodiment, a working experiment similar to that in the first embodiment was carried out while changing only the lubricants, in order to verify excellent workability attained by employing a liquid prepared from a liquid synthetic detergent containing a rust preventive as a lubricant in a progressive press working step for a stainless steel T nut. In this working experiment, the lubricants were prepared from the liquid synthetic detergents employed in the inventive samples A to I shown in Tables 2 and 3 additionally containing 0.1 wt. % of rust preventives (P5310 and P5960 by Nihon Kosakuyu Co., Ltd.).

As a result of this working experiment, excellent workability was attained similarly to the results of the experiment in the first embodiment shown in Tables 2 and 3, and rusting was prevented in parts of the working equipment consisting of corrodible metal materials other than stainless steel to which the lubricants adhered. Thus, it has been verified that the present embodiment implements a further remarkable working method which can prevent rusting of working equipment such as dies, without diminishing the functions and effects attained by the working method according to the first embodiment.

In order to verify excellent workability attained by employing a lubricant prepared from a liquid synthetic detergent in the tapping step for forming the female screw of the stainless steel T nut described in relation to the aforementioned embodiment, a tapping experiment was executed on unannealed and annealed intermediate products of stainless steel T nuts with lubricants prepared from the synthetic detergents employed for the inventive samples A to I shown in Tables 2 and 3 additionally containing 0.1 wt. % of rust preventives. Also in this experiment, a tapping machine was employed with bent taps of 8×1.25 millimeters and 5/16 to 18 inches, similarly to the first embodiment. Consequently, tendencies substantially similar to those of the results shown in Tables 2 to 4 were obtained in relation to workability as to all of the unannealed and annealed intermediate products. Further, it was confirmed that no rusting was caused in parts of the tapping machine to which the lubricants adhered.

Thus, it can be said that a remarkable production step of tapping an intermediate product of a stainless steel T nut separated from a metal plate without an annealing step has been verified as implementable by the working method employing the lubricant according to this embodiment.

Figure 6:
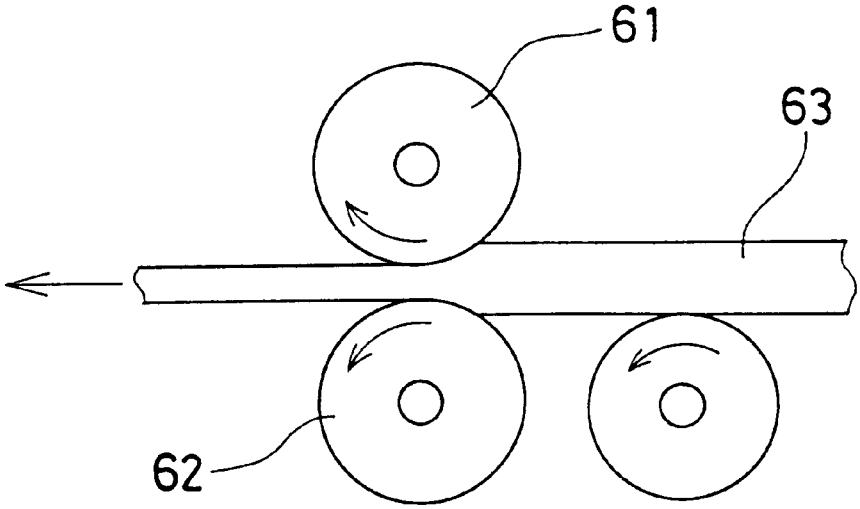
FIG. 6 PRIOR ART
FIG. 6 typically shows a step of rolling a stainless steel plate with a roller, to which the inventive method of working a metal member can be applied.
Figure 7A:
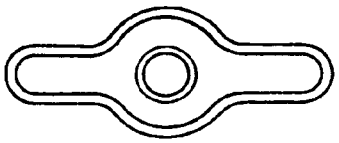
FIG. 7A PRIOR ART
FIG. 7A is a plan view showing a butterfly nut or wing nut manufactured by forging and tapping a wire of stainless steel, to which the inventive method of working a metal member can be applied.
Figure 7B:
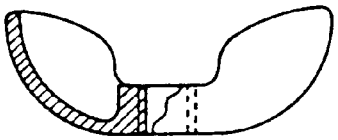
FIG. 7B PRIOR ART
FIG. 7B is a partially sectioned front elevational view of the butterfly nut.

The working method according to this embodiment is also widely and effectively applicable to a step of forming not only the stainless steel T nut but also a stainless steel flexible tube employed for a sprinkler for fire prevention, and to a rolling step of cold-rolling a stainless steel plate (or a stainless steel wire) 63 with the rollers 61 and 62 shown in FIG. 6, a step of manufacturing an intermediate product of a nut such as the butterfly nut shown in FIGS. 7A and 7B from a wire of stainless steel, a step of forming a female screw on the intermediate product of the nut by tapping, and the like.

In relation to a third embodiment of the present invention, it will now be described how the inventive lubricant has been applied to manufacturing a T nut from a carbon steel plate made of a ferrous metal which is inferior in corrosion resistance relative to stainless steel.

In relation to this embodiment, the inventor has first made the following test as a preliminary experiment, to study whether or not the inventive lubricant is applicable to a workpiece of carbon steel which is inferior in corrosion resistance relative to stainless steel.

i. A lubricant was prepared by introducing about 0.1 wt. % of the rust preventive (P5310 or P5960 by Nihon Kosakuyu Co., Ltd.) into "Liquid Bonus" detergent by P & G Co., which has the same composition as the lubricant for the inventive sample I shown in Table 3.

ii. Samples were prepared by adhering Liquid Bonus detergent containing no rust preventive to the surface of a carbon steel plate (SPCC under JIS) and adhering the lubricant prepared in the above item i (the liquid prepared by introducing about 0.1 wt. % of the rust preventive into the Liquid Bonus) to the surface of the same type of carbon steel plate, and these samples were allowed to stand under the same conditions.

iii. After a lapse of a constant time, the sample prepared by adhering Liquid Bonus containing no rust preventive to the surface of the carbon steel plate was rapidly rusted from its periphery. On the other hand, no rusting was visually recognized on the sample prepared by adhering the lubricant prepared in the above item i to the surface of the carbon steel plate. Namely, it was confirmed that there is a possibility of working a workpiece of a ferrous metal material such as a carbon steel plate which is inferior in corrosion resistance relative to a stainless steel plate by using as a lubricant a liquid prepared by introducing about 0.1 wt. % of rust preventive into a liquid synthetic detergent mainly composed of a surface active agent.

In order to verify that the results of the aforementioned preliminary experiment are also applicable to actual steps of manufacturing a T nut, a manufacturing experiment similar to that in the first embodiment was performed with lubricants prepared from the liquid synthetic detergents employed for the inventive samples A to I shown in Tables 2 to 4 additionally containing 0.1 wt. % of rust preventives (P5310 and P5960 by Nihon Kosakuyu Co., Ltd.) for manufacturing T nuts from carbon steel plates which are ferrous metal plates having no corrosion resistance dissimilarly to stainless steel, as the third embodiment of the present invention. A progressive press working step for a T nut including a multistage drawing step for forming its shaft part, which is substantially the same as that for manufacturing the T nut described with reference to FIGS. 1A, 1B, 2A and 2B, can be basically employed also in this case, and hence a detailed description of the manufacturing steps in this embodiment is omitted.

Also when the T nuts were manufactured from the carbon steel plates which are inferior in corrosion resistance relative to stainless steel plates in this embodiment, results substantially similar to those of the first embodiment shown in Tables 2 to 4 were attained in relation to workability, and it was possible to manufacture the T nuts without rusting the carbon steel plates employed as workpieces and the working equipment such as dies.

In this embodiment, a similar trial manufacturing experiment was carried out on comparative samples employing lubricants consisting of only liquid synthetic detergents having components similar to those of the lubricants employed for the inventive samples A to I and containing no rust preventives, to confirm that carbon steel plates employed as workpieces were rapidly rusted. Namely, it is understood that it is necessary to introduce at least about 0.1 wt. % of rust preventive into a synthetic detergent that is to be used as a lubricant for working a metal material such as a carbon steel plate which is inferior in corrosion resistance relative to a stainless steel plate.

The method of working a metal member according to this embodiment is also widely and effectively applicable not only to a step of forming a carbon steel plate T nut, but also to a rolling step of cold-rolling a carbon steel plate (or a carbon steel wire) 63 with the rollers 61 and 62 shown in FIG. 6, a step of manufacturing an intermediate product of a nut such as the butterfly nut shown in FIGS. 7A and 7B from a wire of carbon steel, a step of forming a female screw on the intermediate product of the nut by tapping, and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of working a metal member comprising the following steps:

supplying an oil-free lubricant consisting of a liquid synthetic detergent that is mainly composed of a surfaceactive agent to a metal plate consisting of a work-hardenable material, and excluding the application of a lubricating oil onto said metal plate; and press working said metal plate with said oil-free lubricant thereon by holding and press-forming said metal plate between male and female dies to form said metal member.

2. The method of working a metal member in accordance with claim 1, wherein said liquid synthetic detergent contains at least 27% of said surface active agent.

3. The method of working a metal member in accordance with claim 1, wherein said liquid synthetic detergent contains at least 37% of said surface active agent.

4. The method of working a metal member in accordance with claim 1, wherein said liquid synthetic detergent contains at least 42% of said surface active agent.

5. The method of working a metal member in accordance with claim 1, wherein said liquid synthetic detergent further contains alkyl ether sodium sulfate, and at least one of a fatty acid compound and an alkylbenzene.

6. The method of working a metal member in accordance with claim 5, wherein said liquid synthetic detergent contains said fatty acid compound and further contains at least one of an alpha olefin sodium sulfonate and an alkylamine oxide.

7. The method of working a metal member in accordance with claim 1, expressly excluding a step of washing said oil-free lubricant off of said metal plate using a non-water solvent.

8. A method of working a metal member comprising employing a liquid synthetic detergent as an oil-free lubricant and excluding the use of a lubricating oil, while performing working on a corrosion-resistant metal material to form a prescribed metal member.

9. The method of working a metal member in accordance with claim 8, wherein said metal material is in the form of a plate, and said working includes a step of drawing said plate.

10. The method of working a metal member in accordance with claim 8, wherein said corrosion-resistant metal material is a plate of stainless steel, said prescribed metal member is a T nut including a shaft part, and said working is press working including a plurality of stages of drawing for forming said shaft part of said T nut from said plate of stainless steel.

11. The method of working a metal member in accordance with claim 8, wherein said prescribed metal member is a T nut including a shaft part, and said working is thread cutting for forming a female screw threading on the inner periphery of said shaft part of said T nut.

12. The method of working a metal member in accordance with claim 8, wherein said corrosion-resistant metal material is a plate of stainless steel, said prescribed metal member is a T nut including a shaft part, and said working comprises a plurality of stages of drawing for forming said shaft part of said T nut from said plate of stainless steel and thread cutting for forming a female screw threading on the inner periphery of said shaft part of said T nut.

13. The method of working a metal member in accordance with claim 12, wherein no annealing step is performed between said plurality of stages of drawing and said thread cutting.

14. The method of working a metal member in accordance with claim 8, wherein said corrosion-resistant metal material is in the form of a plate or a wire, and said working is rolling with a roller.

15. The method of working a metal member in accordance with claim 8, wherein said corrosion-resistant metal material is in the form of a wire, and said working comprises at least one of forming an intermediate product of a nut and thread cutting for forming a female screw threading on said intermediate product of said nut.

16. A method of working a metal member comprising employing an oil-free lubricant comprising a liquid that is mainly composed of a surface-active agent and that further contains polyoxyethylene alkyl ether, alkyl sulfuric ester and fatty acid, and excluding the use of a lubricating oil, while performing working on a plate of stainless steel to form a prescribed metal member.

17. A method of working a metal member comprising the following steps:

supplying an oil-free lubricant consisting of a liquid synthetic detergent that is mainly composed of a surface-active agent, and a rust preventive agent to a metal plate, and excluding the application of a lubricating oil onto said metal plate; and press working said metal plate with said oil-free lubricant thereon by holding and press-forming said metal plate between male and female dies.

18. A method of working a metal member comprising employing an oil-free liquid containing a liquid synthetic detergent and a rust preventive as an oil-free lubricant and excluding the use of a lubricating oil on a metal material, while performing working on said metal material to form a prescribed metal member.

19. The method of working a metal member in accordance with claim 18, wherein said metal material is in the form of a plate, and said working includes a step of drawing said plate.

20. The method of working a metal member in accordance with claim 18, wherein said metal material is a metal plate, said prescribed metal member is a T nut including a shaft part, and said working is press working including a plurality of stages of drawing for forming said shaft part of said T nut from said metal plate.

21. The method of working a metal member in accordance with claim 18, wherein said prescribed metal member is a T nut including a shaft part, and said working is thread cutting for forming a female screw threading on the inner periphery of said shaft part of said T nut.

22. The method of working a metal member in accordance with claim 18, wherein said metal material is a metal plate, said prescribed, metal member is a T nut including a shaft part, and said working comprises a plurality of stages of drawing for forming said shaft part of said T nut from said metal plate and thread cutting for forming a, female screw threading on the inner periphery of said shaft part of said T nut.

23. The method of working a metal member in accordance with claim 22, wherein no annealing step is performed between said plurality of stages of drawing and said thread cutting.

24. The method of working a metal member in accordance with claim 18, wherein said metal material is in the form of a plate or a wire, and said working is rolling with a roller.

25. The method of working a metal member in accordance with claim 18, wherein said metal material is in the form of a wire, and said working comprises at least one of forming an intermediate product of a nut and thread cutting for forming a female screw threading on said intermediate product of said nut.

26. The method of working a metal member in accordance with claim 18, further comprising using said oil-free liquid as an oil-free lubricant on working equipment that is used for performing said working on said metal material.

27. A method of working a metal member comprising employing an oil-free lubricant comprising a liquid that is mainly composed of a surface-active agent and that further contains polyoxyethylene alkyl ether, alkyl sulfuric ester, fatty acid and a rust preventive agent, and excluding the use of a lubricating oil, while performing working on a metal plate to form a prescribed metal member.

* * * * *

UNITED STATES PATENT AND TRADEMARK OFFICE
CERTIFICATE OF CORRECTION

PATENT NO. : 5,908,664

DATED : June 1, 1999

INVENTOR(S) : Nagayama

It is certified that error appears in the above-identified patent and that said Letters Patent is hereby corrected as shown below:

Col. 5, line 55, replace "Of" by --of--;

Col. 8, line 54, replace "surfaceactive" by --surface-active--;

Col. 9, line 40, replace "Of" by --of--;

Col. 18, line 16, replace "faceactive" by --face-active--.

Signed and Sealed this

Sixteenth Day of November, 1999

*Attest:*

Q. TODD DICKINSON

*Attesting Officer*

*Acting Commissioner of Patents and Trademarks*